United States Patent [19]

Bennwik et al.

[11] 4,411,358

[45] Oct. 25, 1983

[54] PACKAGE

[75] Inventors: Percy Bennwik, Saltsjö-Boo; Birger Hjertman, Vällingby, both of Sweden

[73] Assignee: Vitrum AB, Stockholm, Sweden

[21] Appl. No.: 329,275

[22] PCT Filed: Apr. 9, 1981

[86] PCT No.: PCT/SE81/00110

§ 371 Date: Dec. 7, 1981

§ 102(e) Date: Dec. 7, 1981

[87] PCT Pub. No.: WO81/02876

PCT Pub. Date: Oct. 15, 1981

[30] Foreign Application Priority Data

Apr. 10, 1980 [SE] Sweden ..... 8002709

[51] Int. Cl.[3] ..... B65D 25/00

[52] U.S. Cl. ..... 206/45.34; 383/38; 383/89; 383/106; 383/111; 383/113; 604/404; 604/408

[58] Field of Search ..... 206/45.34, 0.5, 216, 206/525; 229/56, 53; 128/272; 222/107, 218

[56] References Cited

U.S. PATENT DOCUMENTS

| | | | |
|---|---|---|---|
| 2,011,179 | 8/1935 | Krout | 206/45.34 |
| 3,285,495 | 11/1966 | Colato | 206/45.34 |
| 3,460,741 | 8/1969 | Kugler | 229/56 |
| 3,800,994 | 4/1974 | Bowen et al. | 229/56 |
| 4,146,133 | 3/1979 | Bogorad et al. | 229/56 |

FOREIGN PATENT DOCUMENTS

| | | |
|---|---|---|
| 2539351 | 3/1977 | Fed. Rep. of Germany . |
| 1240714 | 4/1960 | France . |

*Primary Examiner*—Joseph Man Fu Moy
*Attorney, Agent, or Firm*—Cushman, Darby & Cushman

[57] ABSTRACT

The invention relates to a package protecting its contents from the influence of light, microbial contamination and gas transport in either direction but which makes possible a visual control of the contents before the package is used.

According to the invention, the package is made of a light-proof outer bag (1) and a light permeable inner bag (3) arranged inside the outer bag. The outer bag (1) and the inner bag (3) are each sealed at one of their ends (2,4) and are bonded around their periphery (6) close to their other end, and the two bags extend over this bond and are then commonly joined and sealed. By opening one of the end seals in the outer bag (1), the inner bag (3) can be turned out of the outer bag, and the contents (5) of the package can be observed visually through the inner bag.

The package of the invention is especially suitable for storage of preparations for parenteral administration and especially infusion solutions intended to be given intravenously.

9 Claims, 8 Drawing Figures

PACKAGE

This invention relates to a package protecting its contents against the influence of light, gases and aromas but making possible a visual control of the contents before it is taken out of the package.

Due to their properties, many products require a package which is light-proof, gas-tight or aroma-tight in order that the properties of the product in the package should not be impaired. Many packages meeting these demands are also known, and e.g. different plastic foil materials have been found to be suitable for manufacture thereof. Many laminated plastic foil materials, especially laminates of plastic foil and aluminum foil, have been found to be an excellent combination of light and gas tightness, as the same time as they have a good mechanical strength, can be easily worked to packages of various shapes and are inexpensive. It is also of importance that such laminates can be produced that have a sufficient heat stability to be autoclaved. In this way the package and the enclosed product can be heat sterilized simultaneously, which is of a great importance when packing e.g. medicines and bandaging materials.

One disadvantage of light-proof packages of plastic foil material is that they do not make possible a visual control of the contents before the package is opened. However, in certain cases it is very desirable to be able to check the contents visually in an unopened package before it is to be used, and in some of these cases this is an imperative demand. This applies especially to solutions intended to be infused intravenously or otherwise administered parenterally to a patient. Here it is absolutely necessary to be able to check visually before the infusion or administration that the solution has not deteriorated and e.g. has not become cloudy, discoloured or deposited a precipitate. An administration of such a deteriorated solution may have fatal consequences for a patient. The same also applies to blood for transfusions.

Glass bottles with rubber stoppers have been used for a long time as packages for infusion solutions and blood for transfusion. The glass bottles can be stored in a light-proof casing an permit a visual control of the contents before use and, moreover, they are gas-tight and protect against microbial contamination if the rubber seal is suitably designed. However, they have also considerable disadvantages as they are heavy and sensitive to shocks. They are also relatively expensive to manufacture. Furthermore, it is necessary to introduce air into the bottle when liquid is to be drawn off, and this may cause contamination of the contents. In order to eliminate the disadvantages of the glass bottles, various types of plastic packages in the form of bags for infusion solutions and blood for transfusions have recently been developed. Such packages can be compressed as the contents are consumed, and no air need be introduced. However, the problem remains that if the package is to protect the contents against light in storage, it has not been possible to check the contents visually before use. It might be possible to use a separate, light-proof casing of e.g. cardboard or opaque plastic foil, but this will be impractical when handling and using the package.

The disadvantages indicated above are eliminated by the package of the present invention and a bag-shaped package is provided which protects the contents of the package against light and gases for the whole time in storage and transport, but makes possible a visual control of the contents before it is taken out of the package.

The invention refers to a package for protection of a product packed therein against the influence of light, gases and/or aromas, and which makes possible a visual control of the product before the package is opened, the package being characterized in that it comprises a light-proof outer bag and a light permeable inner bag placed inside the outer bag, the outer and inner bags each being sealed at one of their ends and bonded to each other around their periphery close to their other end, and, moreover, being connected at the same end, at or beyond their peripheral bonding, so that the inner and outer bags are sealed in common, so that the inner bag after opening of at least one of the seals of the outer bag can be folded or turned out of the casing of the outer bag and the contents can observed visually in this way.

In one embodiment of the invention, the package contents is arranged between the outer and inner bags, and after removing or opening the common seal, the inner bag can be turned out of the outer bag simultaneously as it is turned inside out.

According to another embodiment of the invention, the contents of the package is arranged inside the inner bag, and after removing or opening the end seal of the outer bag only, the inner bag can be folded out of the outer bag.

The invention is illustrated more closely in the following detailed description together with the accompanying drawing, in which parts acting in the same way have the same designations.

FIG. 1 in the drawing schematically shows a sectional view of a first embodiment of a package according to the invention.

Figure 6:
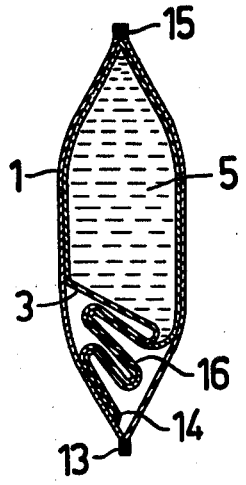

FIG. 6 schematically shows a sectional view of a second embodiment of a package according to the invention.

Figure 7:
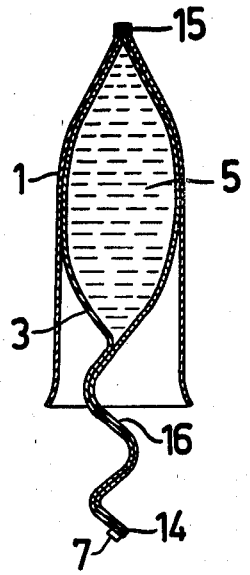

FIG. 7 shows the package at unfolding of the inner bag, and

Figure 8:
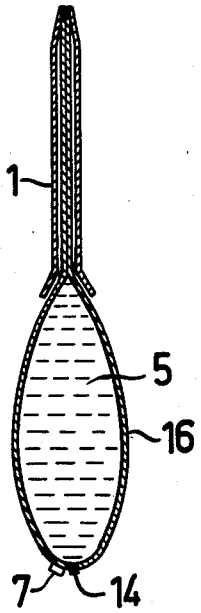

FIG. 8 shows the same package after the inner bag being completely unfolded.

Figure 1:
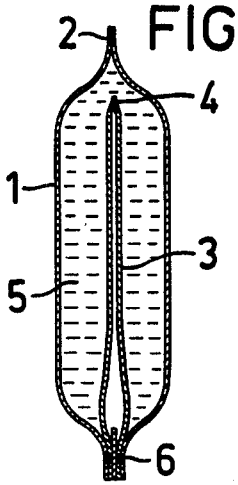

In FIG. 1, an outer bag 1 is shown, which is sealed at its upper end by means of e.g. a welding seam 2. Inside the outer bag an inner bag 3 is arranged, which is also sealed at its upper end, e.g. by means of a welding seam 4. Between the outer and inner bags is arranged the packing contents 5, which in most cases is a liquid. The outer and inner bags are joined and sealed at the lower end 6 in a way as shown in detail in the following. In this position, the package contents 5 is completely enclosed by the light and gas-tight outer bag 1, and is thus protected against light and penetration of gases.

Figure 2:
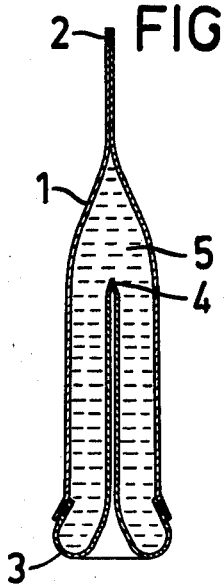
FIG. 2 shows the same package when the inner bag i turned out.

In FIG. 2 the seal at the lower end 6 has been opened in a way as shown in detail in the following, and the inner bag 3 has just started being turned out at the same time as it is turned inside out, In FIG. 3, the contents of the package 5 is completely within the turned-out inner bag 3, which is preferably made of a transparent material, and can thus be inspected and checked visually. However, the package is still completely sealed by the seals at 2, 4 and 6, and the package contents is thus protected against penetration of gases and microbial contamination. For drawing off the contents, a tapping device can be arranged as shown schematically at 7. Such a tapping device can be of a conventional design.

Figure 4:
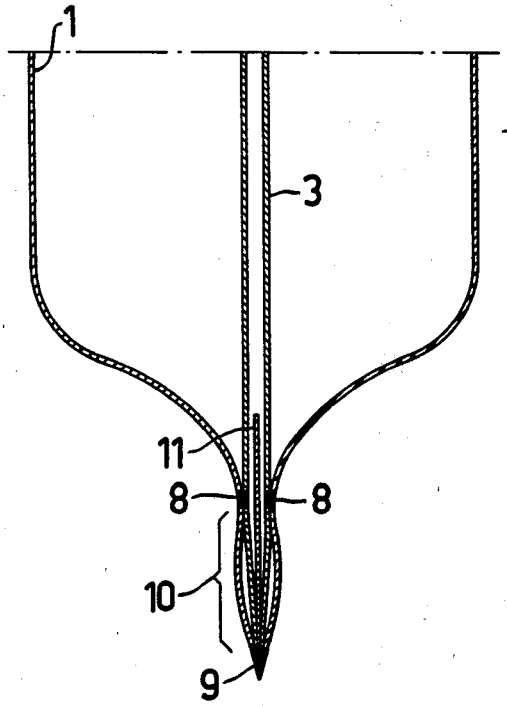
FIG. 4 shows in detail the sealing of the lower end of the package shown in FIG. 1.

FIG. 4 shows in detail schematically a sectional view of the seal at the lower end 6 of the package. The outer bag 1 and the inner bag 3 are here joined around there periphery by a welding seam 8, by which the contents 5 of the package is effectively enclosed between the outer and inner bags. However, the welding seam 8 does not seal the inner bag 3 permanently, but this is still open at its lower end or at least only loosely closed so that it can be easily opened without damage to the inner or outer bag. The inner and outer bags are permanently joined and sealed by means of another welding seam 9, which is arranged at some distance 10 from the upper welding seam 8.

In order to prevent the permanent sealing of the inner bag 3 already by the upper welding seam 8 in the manufacture of the package, an adhesion-controlling foil 11 can be arranged inside the inner bag at its lower end. This foil is of a material having such surface or release properties that at the formation of the upper welding seam around the periphery of the facing surfaces located around the periphery of the outer and inner bags, it will also prevent the formation of a permanent bond between the insides of the inner bag. It is realized that at least one side of the foil must have such surface properties while the other side may adhere to the inside of the inner bag, and in practice this is a preferred embodiment. The foil can also have such surface properties that a welding seam which can be easily opened is obtained between the insides of the inner bag.

When opening the package, part of the lower end of the package with lower welding seam 9 along the interspace 10 between the welding seams 8 and 9 is cut off or torn up. The seal of the inner bag 3 is then broken, and the latter can be forced out of the outer bag 1 simultaneously as it is turned inside out. The contents os the package 5 runs down into the inner bag according this is forced out and can be checked visually in the inner bag.

Figure 5:
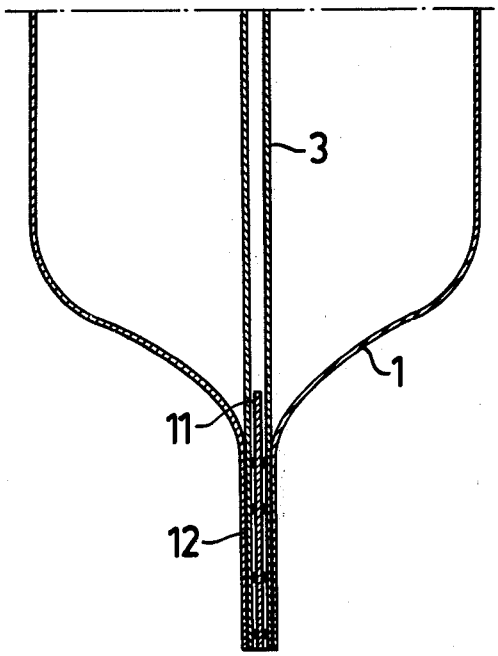
FIG. 5 shows another embodiment of the seal.

In FIG. 5 another embodiment of the seal at the lower end of the package is shown. Here one single welding seam 12 is formed between the outer bag 1, the inner bag 3 and the weld protecting foil 11. In this case the foil 11 has such adhesive properties that it makes possible a joint between the insides of the inner bag, which joint can be opened, the connection however being sufficiently strong for the package to stand normal handling. However, a permanent bond is formed between the outer and inner bags which cannot be opened without damage to them. When this package is to be opened the joint between the insides of the inner bag is quite simply torn up, and the inner bag can be forced out and turned inside out.

FIG. 6 shows another embodiment of a package according to the invention. Here the contents 5 of the package are inside the light permeable inner bag 3 which, in its turn, is arranged inside the light and gas-tight outer bag 1. The outer bag is sealed at is lower end by the welding seam 13, and the inner bag is sealed by the welding seam 14 at it lower end. These two welding seams can be made in the same way as the welding seams 2 and 4 shown in FIG. 1. The outer and inner bags are joined and sealed in common at their upper ends by the welding seam 15. This can be made as a simple, common welding seam.

In this package, the inner bag is longer than the outer bag so that a loose portion 16 of the inner bag is obtained. When the contents is to be used, the welding seam 13 is cut or torn up, the inner bag 3 being folded out of the outer bag 1, mostly by the influence of the weight of the package contents 5. In this case, the inner bag will not be turned inside out, but as it is longer than the outer bag and is not completely filled with the package contents, the filled portion will extend outside the light-proof outer bag, and the contents can be inspected and checked visually. FIG. 7 shows the package with the inner bag partly unfolded, FIG. 8 shows the package with the inner bag completely unfolded, filled with the product and in a position for a visual control.

In the same way as in the previously shown embodiment, the inner bag can be provided with a tapping device 7. This device can also be adapted to be used for filling in the cases when the package contains a concentrate which is e.g. to be diluted with water. This applies of course to all embodiments of the package according to the invention.

It is apparent from the above that it essential that the inner bag in a fully unfolded state is longer than the outer bag. Only in this way will the inner bag have the big volume required for liquid to be filled and that even after filling, the filled portion of the bag should be completely outside the outer bag so that its contents can be observed. An inner bag which is not considerably longer than the outer bag cannot meet these demands.

In this way a packed concentrate can be stored protected against light and gases but before use it can be diluted with liquid, all under a visual control of the dilution procedure and the contents. The inner bag can here be calibrated and provided with markings showing hos much liquid is to be filled.

Several devices for supply or tapping can also be arranged in the same inner bag. At infusion of several liquids in combination, e.g. when an amino acid solution, a fat emulsion and a carbohydrate solution are to be infused at the same time, several inner bags can be connected in parallel. By fixed constrictions after the various bags, a constant amount ratio can be obtained between the various liquids. Only one adjusting means for the flow rate to the patient is required in this case. As the packages are soft and can be compressed so that no air need be introduced, the maintenance of a constant amount ratio is simplified.

As indicated in the foregoing, a package according to the invention has been found to be especially suitable for packing liquid solutions and dispersions for parenteral infusion or transfusion, as in this case it is of an especially great importance that the contents can be protected against light, penetration of gases and microbial contamination, and at the same time it must be possible to check the contents visually before use. However, the package is not restricted to merely this type of use but can be used in principle for any material that must necessarily be stored protected against the influence of light, gases or loss of aromas or other constituents, but where it is desired to inspect the contents visually before it is taken out of the package.

One field of application where the present package has been found to be suitable is packing of enteral diet preparations intended to be given to a patent through a tube. Such preparations can be present in a state ready for use as a concentrate or a powder intended to be mixed with water. Here it is possible to store the product protected from light and microbial contamination.

Figure 3:
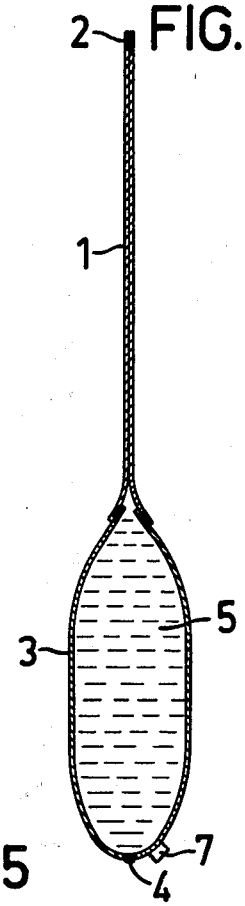
FIG. 3 shows the package with the inner bag completely turned out and with the contents in the inner bag.

Liquid for dilution of the contents of the inner bag is supplied by means of a combined filling and tapping means (7 in FIG. 3 or 7 in FIG. 8). As the package is soft, it is easy to mix the various materials and the transparent inner bag makes possible a control that a correct mixture is obtained. Previously, diet preparations in the form of a powder have usually been delivered in bags or cans, and it has been necessary to carry out mixing with liquid in mixing vessels, after which the mixture ready for use has been transferred to a bottle or bag for administration by means of a tube. By the present invention, most of these handling steps and the transfer of preparations between various vessels are eliminated so that the risks of microbial contamination is reduced in this way and less work is required.

As a material for the package, various plastic foil materials are preferably used, expecially in the form of laminates. The outer bag should be of a material which is light and gas-tight, and a laminate of aluminum foil and one or more plastic foils have been found to be suitable for this. Preferably the plastic foils are of a type which can be welded, the aluminum foil being coated with such a foil on both sides. It is also possible to use aluminum foil coated with one or more layers of a lacquer making possible heat sealing. Instead of laminates with aluminum foil it is further possible to use plastic foils for the outer bag which have been made opaque in a suitable way, e.g. by admixture of black colored pigments or by aluminizing.

The inner bag is made of a plastic foil material which is permeable to light and then preferably is translucent or most preferably transparent. The material should also be heat sealable. It goes without saying that the material of the inner and outer bags must not be unfavourably influenced by or exert any disadvantageous influence on the contents of the package, e.g. by migration of a plasticizer or stabilizer.

The inner bag should also be made of a gas aroma-tight material, but the requirements in this respect need not be as high as for the outer bag, as the inner bag in enclosed by the outer bag in storage and transport.

It is suitable that the foil materials used are sufficiently heat tolerant so that the package may be sterilized by autoclaving.

The adhesion-controlling foil which is to be placed in the opening of the inner bag to prevent the inner bag from being permanently sealed must be made of a material having such adhesive and release properties, as stated above, that a permanent bond is prevented at least to one of the sides of the foil. It is a preferred embodiment that the protective foil is fully sealable on one of its sides as it can then be attached to one of the insides of the outer bag and this way cannot be moved from its correct position in the manufacture of the package, but simultaneously prevents the inner bag from being permanently sealed. It is not quite necessary that the protective foil completely prevents a bond at one of its sides, but it can be sufficient that only a weak bond is formed which can easily be torn up without damage to the inner or outer bags. The adhesion-controlling foil is thus most suitably made of a laminated foil having different materials on each of its surfaces and consequently different adhesive properties. Of course the adhesive properties are also dependent on which temperature the heat sealing is carried out and this temperature, in its turn, is dependent on the foil material used for the inner and the outer bags.

Suitable plastic foil materials can easily be selected by one skilled in the art starting from such properties as tightness, sealability, resistance to migration of materials etc., which are required in each specific case. Such plastic materials as polypropylene, copolymers of ethylene and propylene and polyamides are suitable. Plastic materials such as polyvinyl chloride and polyvinylidene chloride are also useful provided that the problems of the release of plasticizer can be mastered. Plastic foil materials can be selected on the basis of known material properties and simple routine tests.

The design of the package in detail is not especially critical as long as the package lies within the scope of the definition given in the main claim. Thus, it is suitable that the end of the package which in use should be uppermost is provided with holes for suspension which can easily be formed when this end is welded. Furthermore, the inner bag can be calibrated and provided with graduation marks so that it can be read how much of the contents has been drawn off. The means arranged on the inner bag for tapping and optionally also for filling of liquid can be formed in any conventional manner.

The package according to the invention can be manufactured in a process that is easily apparent to one skilled in the art. It is preferably started from tubes of the plastic foil materials which are to form the outer and inner bags and the material for the inner bag is arranged within the outer bag, after which the bags are sealed so that a package of the desired design is obtained. This can be carried out in a continuously operating apparatus of a type known to one skilled in the art. Filling of the package contents can be accomplished in connection with the manufacture of the packages or after blanks for the packages have first been prepared. Where applicable, e.g. in the filling of infusion solutions, it is necessary to make sure that the process is bacteriologically without objections so that no contamination of the contents is obtained. Equipment for sterile filling of a liquid into bag-shaped packages is previously known and can be adapted to the package of the invention by one skilled in the art.

In the present specification, examples of various embodiments of a package for light- and gas-tight storage of a product have been shown, a visual control of the product being made possible before the package is opened. However, it is realized that the invention is not restricted to merely the examples of embodiments indicated here. Thus, it is e.g. not strictly necessary that the package is sealed by heat sealing or welding but it is also possible to seal the package by the use of suitable bonding agents, provided the other demands made on the package are satisfied.

We claim:

1. A package for protection of a product packed therein against the influence of light and/or gases but making possible a visual control of the contents of the package before said package is opened, characterized in that it comprises a light-proof outer bag and a light-permeable inner bag arranged inside the outer bag, the outer and inner bags each being sealed at one of their ends, and being bonded to each other around their periphery close to their other end and furthermore at the same end, at or beyond the peripheral bonding, viewed from the sealed ends, being connected so that the inner and outer bags are sealed in common, the contents of the package being arranged between the outer bag and the inner bag, such that after removal or opening of the common seal, the inner bag can be turned out of the outer bag at the same time as it is turned inside out, and the contents of the package in this way can be visually observed through the wall of the inner bag.

2. The package of claim 1, characterized in that at the peripheral bonding between the outer and inner bags, inside the inner bag is arranged an adhesion-controlling foil of a material with such adhesive properties that a permanent bond between the insides of the inner bag is prevented at the formation of the peripheral bonding.

3. The package of claim 1 or 2, characterized in that the peripheral bonding between the outer bag and the inner bag and the common seal thereof are arranged at the same place, the adhesion-controlling foil having such adhesive properties that it makes possible a connection between the insides of the inner bag which can be opened.

4. The package of claim 2, characterized in that the adhesion-controlling foil has such adhesive properties that one of its sides can be permanently bonded to the inside of the inner bag, while its other side prevents a permanent bond.

5. The package of claim 1, characterized in that the inner bag and the outer bag are made of a plastic foil material, preferably a laminate.

6. The package of claim 5, characterized in that the outer bag is made of a laminate of a plastic foil and an aluminum foil.

7. The package of claim 1, characterized in that the bonds and the seals between the bags are made by heat welding.

8. The package of claim 5 wherein the outer bag is made of an aluminum foil coated with at least on lacquer layer.

9. The package of claim 5 wherein the lacquer layer is heat sealable.

* * * * *